US005850795A

United States Patent [19]

Taillon

[11] Patent Number: 5,850,795

[45] Date of Patent: Dec. 22, 1998

[54] RAIL CAR TRUCK DAMPING SYSTEM

[75] Inventor: Armand P. Taillon, Chicago, Ill.

[73] Assignee: Standard Car Truck Company, Park Ridge, Ill.

[21] Appl. No.: 990,131

[22] Filed: Dec. 15, 1997

[51] Int. Cl.[6] ..... B61F 5/06

[52] U.S. Cl. ..... 105/198.2

[58] Field of Search ..... 105/198.2, 198.4, 105/198.5; 267/196

[56] References Cited

U.S. PATENT DOCUMENTS

| | | | |
|---|---|---|---|
| 4,103,623 | 8/1978 | Radwill | 105/198.2 |
| 5,511,489 | 4/1996 | Bullock | 105/198.2 |
| 5,555,817 | 9/1996 | Taillon et al. | 105/198.2 |
| 5,555,818 | 9/1996 | Bullock | 105/198.2 |

*Primary Examiner*—S. Joseph Morano

*Attorney, Agent, or Firm*—Dorn, McEachran, Jambor & Keating

[57] ABSTRACT

A rail car truck damping system includes a bolster with a bolster pocket having an interior slanted wall, a side frame having a column wear resistant surface facing said pocket and a friction wedge positioned within the pocket. The wedge has a body with an area of contact facing the bolster pocket slanted wall which is formed by a pair of spaced planar generally parallel surfaces with a recess therebetween. The bolster pocket slanted wall has an elongated outward extension aligned with the wedge recess and extending therein, with the extension functioning to resist lateral movement of the wedge within the bolster pocket. The wedge body has an area of contact facing the side frame column wear resistant surface which is formed by a pair of spaced planar generally parallel surfaces with a recess therebetween. The side frame column wear resistant surface has a vertical extension aligned with the wedge recess and extending therein, with the extension restraining relative lateral movement between the bolster and the side frame.

17 Claims, 2 Drawing Sheets

Fig.1.
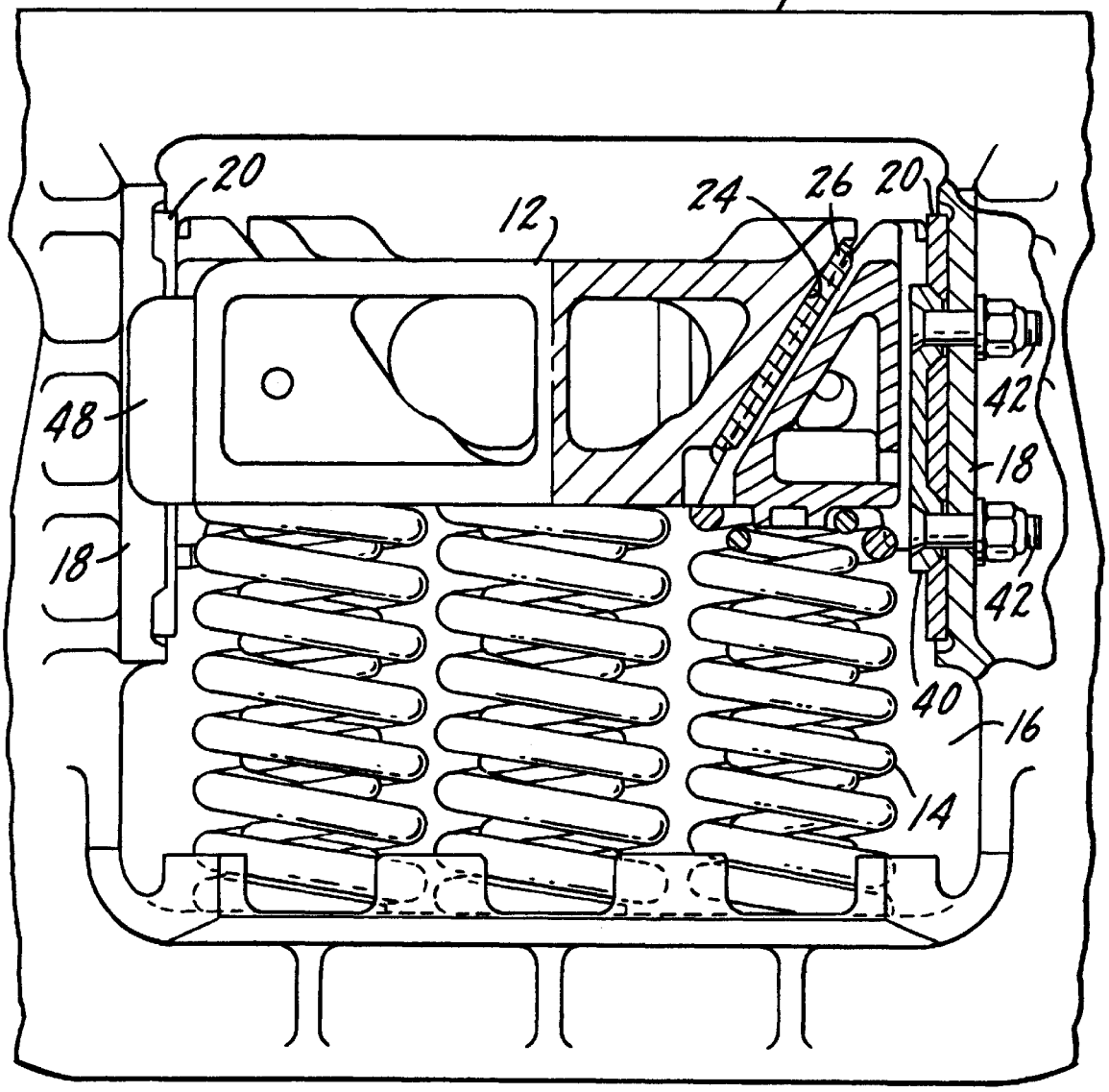
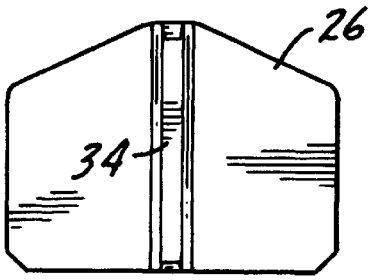
Fig.2.
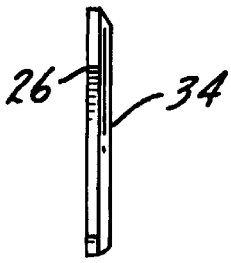
Fig.3.
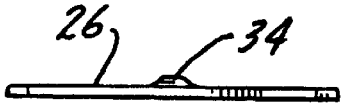
Fig.4.

Fig. 5.
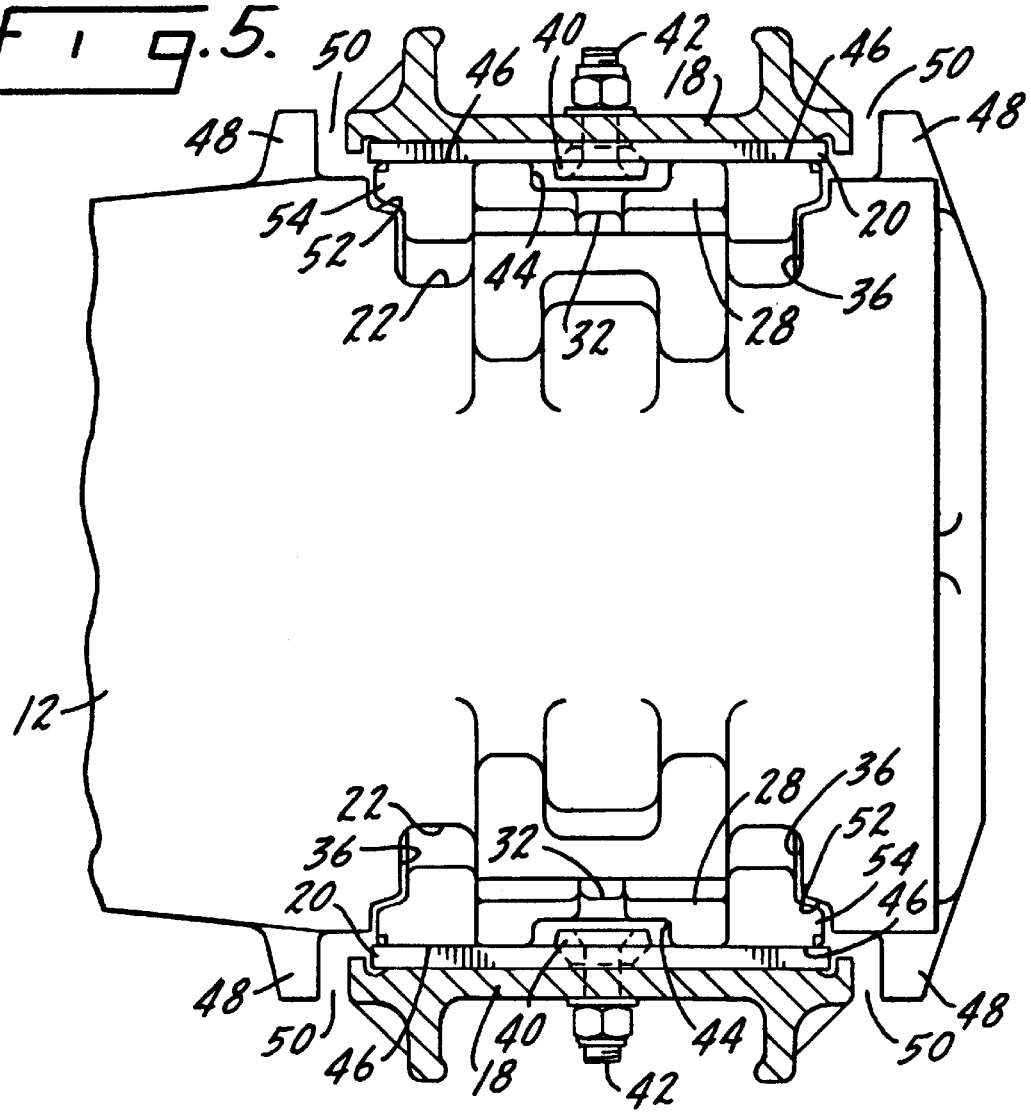
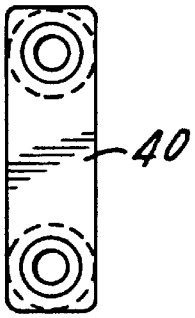
Fig. 6.
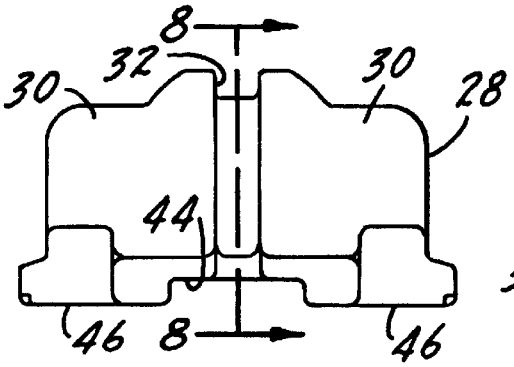
Fig. 7.
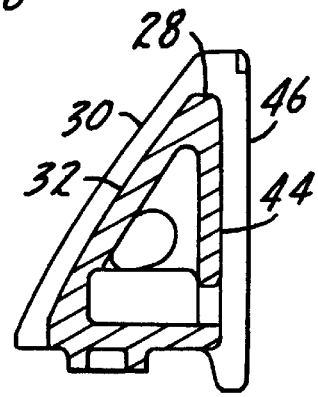
Fig. 8.

RAIL CAR TRUCK DAMPING SYSTEM

THE FIELD OF THE INVENTION

The present invention relates to damping systems for rail cars and more specifically to damping systems for what is known in the art as a "three-piece truck. " Such a truck has a bolster riding on two side frames and the damping system is used to restrain relative movement between the bolster and the side frames. In such damping systems the bolster has pockets which face the column wear surfaces of the side frame and there is a friction wedge positioned in each pocket. The wedge is spring-loaded to bear against a slanted wall of the bolster pocket and against the column wear plate of the side frame.

The forces acting upon such trucks during normal rail car use will cause relative lateral movement between the bolster and the side frame and in the past such movement has been restrained not only by the friction wedge, but also by what are known as gibs which are outwardly-extending projections on the bolster located on each side of the side frame column. The present invention eliminates the necessity of such gibs and provides for lateral restraint between the bolster and side frame in the form of a vertical extension on the side frame column wear plate which extends into an aligned recess on the friction wedge, with the recess being formed between spaced friction wedge surfaces which face the side frame column wear plate.

Similarly, the forces acting upon the rail car truck will cause lateral movement between the friction wedge and the bolster pocket, with such movement at times causing damage to the sides of the bolster pocket. The present invention is also directed to restraining friction wedge movement within the bolster pocket by the use of an extension on the bolster pocket wear plate, which extension fits within a recess between spaced surfaces on the friction wedge which are in contact with the bolster pocket wear plate.

As can be seen, a rail car damping system can include both of the above features or either one or the other. The restraints on relative movement between the bolster and the side frame may be provided in the described manner, but the same friction wedge may not have the described restraint between the wedge and the bolster pocket side walls. Similarly, a wedge may be restrained against lateral movement in the bolster pocket and not use the described restrain to limit lateral movement between the bolster and the side frame.

SUMMARY OF THE INVENTION

The present invention relates to rail car damping systems and more specifically to such damping systems which provide for lateral restraint between the bolster and the side frame and restrained movement of the friction wedge within the bolster pocket.

Another purpose of the invention is to provide a bolster/pocket friction wedge construction in which there is restraint, provided by a bolster pocket extension, to lateral movement of the friction wedge within the bolster pocket.

Another purpose is a rail car damping system in which the side frame column wear plate has a vertical extension which fits within a recess between spaced friction wedge surfaces, which extension limits bolster/side frame relative movement.

Other purposes will appear in the ensuing specification, drawings and claims.

BRIEF DESCRIPTION OF THE DRAWINGS

The invention is illustrated diagrammatically in the following drawings wherein:

FIG. 1 is a partial side view, in part section, illustrating the bolster side frame friction wedge relationship;

FIG. 2 is a front view of the bolster pocket wear plate;

FIG. 3 is a side view of the bolster pocket wear plate;

FIG. 4 is a top view of the bolster pocket wear plate;

FIG. 5 is a partial top view of the bolster and side frame of FIG. 1;

FIG. 6 is a front view of the side frame column wear plate extension;

FIG. 7 is a top view of the friction wedge, and

FIG. 8 is a section along plane 8—8 of FIG. 7.

DESCRIPTION OF THE PREFERRED EMBODIMENT

The present invention will describe a rail car damping system which may utilize a friction wedge of the type illustrated in U.S. Pat. Nos. 5,511,489 and 5,555,818, both owned by Standard Car Truck Company of Park Ridge, Ill., the assignee of the present application. The disclosure of these two patents is herein incorporated by reference.

The '489 and '818 patents show what is described as a dual face friction wedge. A friction wedge has two spaced friction surfaces. One opposes the slanted wall of the bolster pocket and the other opposes the column wear plate of the side frame. In the reference patents both of these surfaces are formed by spaced, generally parallel, planar friction faces. In other words, the area of friction contact between the wedge and both the bolster and the side frame have been separated into two spaced surfaces, specifically for the reasons stated in greater detail in those patents. The present invention utilizes the recess formed between the spaced friction surfaces to provide restraints on side frame/bolster lateral movement and/or wedge/bolster pocket lateral movement. The invention will be described in connection with a rail car truck in which both of these concepts are present. It should be understood that in some applications there may be only restraint to side frame/bolster relative movement, whereas, in other applications there may be only restraint to wedge movement within the bolster pocket.

In FIG. 1, a side frame is indicated at 10 and a bolster 12 is supported on springs 14 within a window 16 of the side frame. As indicated above, there will be two side frames and one bolster in a three-piece truck, with the side frames being supported on the truck wheelsets. The side frame has spaced columns 18, one on either side of the window 16. Each of these columns carries a wear plate 20. The wear plates 20 face pockets 22 to formed at the end of the bolster. What has been described thus far is a conventional three-piece rail car truck damping system with the friction wedge to be described damping relative movement between the side frame and bolster. The bolster pocket 22 has a slanted face 24 and attached to this slanted face 24 is a wear plate indicated at 26 and shown specifically in FIGS. 2, 3 and 4.

The friction wedge is indicated at 28 and there will be one positioned in each bolster pocket 22. The friction wedge 28 has a pair of spaced planar surfaces 30 with a recess 32 formed therebetween and the faces 30 will be in contact with the bolster pocket wear plate 26. The wear plate 26 has a generally centrally located extension or rib indicated at 34 which is preferably welded to the wear plate. The rib 34 has a width such that the rib may be positioned within the recess 32 and will only permit a very limited degree of lateral movement between the wedge 28 and the pocket 22. This protects the walls 36 of the bolster pocket, a location which has been known to evidence substantial wear during normal rail car operation. Contact between the wedge and the bolster pocket wall tends to wear the wall, requiring either that this surface be built up through welding or that the bolster itself be replaced. By restraining lateral movement between the friction wedge and the bolster pocket, such contact can be avoided and the dimensions of the rib 34 and the recess 32 are such as to permit a limited degree of lateral movement, but yet not sufficient lateral movement to allow for contact between the sides of the wedge and the bolster pocket sides 36.

The column wear plate 20 will have a generally centrally located column track 40, shown in FIG. 6, which column track will be attached by bolts 42 to the side frame column wear plate 20. Focusing particularly on FIG. 7, there is a recess 44 between the spaced planar wear surfaces 46 of the friction wedge 28. The surfaces 46 will bear against the column wear plate, as particularly shown in FIG. 5, providing frictional resistance to relative vertical and lateral movement between the bolster and the side frame. The column track 40 has a width relative to the width of the recess 44 to permit a degree of lateral movement between the wedge and bolster and the side frame, but not such lateral movement as to permit contact between the side frame and the gibs 48 located on the bolster at each side of the side frame. The gibs 48 are used in a truck of this design to limit side frame bolster relative lateral movement. However, the gibs are a point of wear on the bolster and must be replaced after a certain length of service time. The gap or space 50 between each gib 48 and the adjacent portion of the side frame is greater than the difference in width between the column track 40 and the recess 44. Thus, the column track will prevent contact between the side frame and the gibs 48. In some applications, the gibs may even be eliminated.

The bolster pocket has a recess 52 on each side thereof which will accommodate a wing 54 on each side of the wedge. The wings will prevent relative pivotal movement between bolster and side frame from causing undesired contact between the bolster and side frame in the area adjacent the bolster pocket.

Since the column track 40 may itself be subject to wear by contact between this member and the sides of the recess 44, column track 40 will be bolted to the column wear plate 20 for ease in replacement.

The invention is particularly designed to prevent wear at two locations on a conventional three-piece rail car truck which in the past has required taking the truck out of service for periodic maintenance. Specifically, the gibs 48 tend to wear because of excessive side frame/bolster contact. The use of the column track which will limit such movement has the clear advantage of eliminating or reducing gib wear.

Similarly, the use of the rib 34 on the bolster pocket wear plate 26 which extends into a recess in the slanted wall facing surfaces of the friction wedge restricts lateral movement of the wedge within the bolster pocket, thus eliminating wear to the sides of the bolster pocket.

Whereas the preferred form of the invention has been shown and described herein, it should be realized that there may be many modifications, substitutions and alterations thereto.

The embodiments of the invention in which an exclusive property or privilege is claimed are defined as follows:

1. A rail car truck damping system including a bolster having at least one bolster pocket with an interior slanted wall, a side frame having a column wear resistant surface facing said bolster pocket, a friction wedge positioned within said bolster pocket, said wedge having a body with an area of contact facing said bolster pocket slanted wall, said bolster pocket facing area of contact being formed by a pair of spaced planar generally parallel surfaces with a recess therebetween, said bolster pocket slanted wall having an elongated outward extension aligned with said wedge slanted wall facing recess and extending therein, said extension functioning to resist lateral movement of said wedge within said bolster pocket, said wedge body having an area of contact facing said side frame column wear resistant surface, said wedge body side frame facing area of contact being formed by a pair of spaced planar generally parallel surfaces, with a recess therebetween, said side frame column wear resistant surface having a generally vertical extension aligned with said wedge side frame facing recess and extending therein, said side frame wear resistant surface extension restraining relative lateral movement between said bolster and side frame.

2. The rail car truck damping system of claim 1 including a wear plate positioned in said bolster pocket and attached to said bolster pocket slanted wall, said bolster pocket extension extending from said wear plate.

3. The rail car truck damping system of claim 2 wherein said wear plate extension is integral with said wear plate.

4. The rail car truck damping system of claim 3 wherein said bolster pocket wear plate extension is generally centrally located thereon.

5. The rail car truck damping system of claim 1 wherein said side frame column wear resistant surface includes a wear plate attached to the side frame.

6. The rail car truck damping system of claim 5 wherein said side frame wear resistant surface vertical extension extends outwardly from said side frame column wear plate.

7. The rail car truck damping system of claim 6 wherein said side frame wear plate extension is attached to said side frame wear plate.

8. The rail car truck damping system of claim 7 wherein said side frame column wear plate extension is generally centrally located thereon.

9. A rail car truck damping system including a bolster having at least one bolster pocket with an interior slanted wall, a side frame having a column wear resistant surface facing said bolster pocket, a friction wedge positioned within said bolster pocket, said wedge having a body with an area of contact facing said bolster pocket slanted wall, said bolster pocket facing area of contact being formed by a pair of spaced planar generally parallel surfaces with a recess therebetween, said bolster pocket slanted wall having an elongated outward extension aligned with said wedge slanted wall facing recess and extending therein, said extension functioning to resist lateral movement of said wedge within said bolster pocket.

10. The rail car truck damping system of claim 9 including a wear plate positioned in said bolster pocket and attached to said bolster pocket slanted wall, said bolster pocket extension extending from said wear plate.

11. The rail car truck damping system of claim 10 wherein said wear plate extension is integral with said wear plate.

12. The rail car truck damping system of claim 11 wherein said bolster pocket wear plate extension is generally centrally located thereon.

13. A rail car truck damping system including a bolster having at least one bolster pocket with an interior slanted wall, a side frame having a column wear resistant surface facing said pocket, a friction wedge positioned within said pocket, said wedge having a body with an area of contact facing said bolster pocket slanted wall, said wedge body having an area of contact facing said side frame column wear resistant surface, said side frame facing area of contact being formed by a pair of spaced planar generally parallel surfaces with a recess therebetween, said side frame column wear resistant surface having a generally vertical extension aligned with said wedge side frame facing recess and extending therein, said side frame wear resistant extension restraining relative lateral movement between said bolster and side frame.

14. The rail car truck damping system of claim 13 wherein said side frame column wear resistant surface includes a wear plate attached to the side frame.

15. The rail car truck damping system of claim 14 wherein said side frame wear resistant surface vertical extension extends outwardly from said side frame column wear plate.

16. The rail car truck damping system of claim 15 wherein said side frame wear plate extension is attached to said side frame wear plate.

17. The rail car truck damping system of claim 16 wherein said side frame column wear plate extension is generally centrally located thereon.

* * * * *